US011554382B2

(12) United States Patent
Jittu

(10) Patent No.: US 11,554,382 B2
(45) Date of Patent: Jan. 17, 2023

(54) PAINT/COATING APPLICATOR LOCATING APPARATUS AND METHOD

(71) Applicant: Alexander I. Jittu, Chesterfield, MI (US)

(72) Inventor: Alexander I. Jittu, Chesterfield, MI (US)

( * ) Notice: Subject to any disclaimer, the term of this patent is extended or adjusted under 35 U.S.C. 154(b) by 0 days.

(21) Appl. No.: 17/864,533

(22) Filed: Jul. 14, 2022

(65) Prior Publication Data

US 2022/0347706 A1 Nov. 3, 2022

Related U.S. Application Data

(62) Division of application No. 15/231,029, filed on Aug. 8, 2016, now Pat. No. 11,413,640.

(51) Int. Cl.

| | |
|---|---|
| ***B05B 12/00*** | (2018.01) |
| ***B05B 12/16*** | (2018.01) |
| ***B05D 1/02*** | (2006.01) |
| ***B05B 13/04*** | (2006.01) |
| *B05D 7/14* | (2006.01) |

(52) U.S. Cl.
CPC ..... *B05B 12/16* (2018.02); *B05B 13/0452* (2013.01); *B05D 1/02* (2013.01); *B05D 7/14* (2013.01)

(58) Field of Classification Search
CPC ..... B05B 12/16; B05B 13/0452; B05D 1/02
See application file for complete search history.

(56) References Cited

U.S. PATENT DOCUMENTS

| | | | | |
|---|---|---|---|---|
| 6,378,220 | B1 * | 4/2002 | Baioff | G01B 5/14 33/502 |
| 7,638,000 | B2 | 12/2009 | Clifford et al. | |
| 8,015,938 | B2 | 9/2011 | Herre et al. | |
| 8,359,997 | B2 | 1/2013 | Vandepitte | |
| 8,393,292 | B2 | 3/2013 | Yoshino et al. | |
| 8,544,409 | B2 | 10/2013 | Herre et al. | |
| 8,939,106 | B2 | 1/2015 | Takahashi | |
| 9,448,555 | B2 * | 9/2016 | Magedanz | B23K 37/0235 |
| 2006/0292308 | A1 | 12/2006 | Clifford et al. | |
| 2009/0304940 | A1 | 12/2009 | Heldt et al. | |
| 2011/0017138 | A1 * | 1/2011 | Hoek | B05B 7/2478 15/159.1 |
| 2012/0145075 | A1 | 6/2012 | Takahashi | |
| 2013/0034660 | A1 | 2/2013 | Koyanagi et al. | |

* cited by examiner

*Primary Examiner* — Nathan T Leong
(74) *Attorney, Agent, or Firm* — Brooks Kushman P.C.

(57) ABSTRACT

An apparatus and method for locating a position of a coating applicator in a coating process for applying coating material to an article. At least one positioning member is attached to a spray applicator at one end and carries a marker at an opposite end capable of depositing a visible track on a markable surface removably attached to the surface of the article to be coated. The positioning member provide a resilient biasing force on the marker to maintain the marker in contact with the surface of the article despite surface topography changes as the article and the marker move relative to each other. The visible track(s) define a centerline or the overall spray pattern of the spray applicator.

7 Claims, 7 Drawing Sheets

PAINT/COATING APPLICATOR LOCATING APPARATUS AND METHOD

CROSS-REFERENCE TO RELATED APPLICATIONS

This application is a Division of U.S. application Ser. No. 15/231,029, filed Aug. 8, 2016 (pending), the disclosure of which is incorporated in its entirety by reference herein.

TECHNICAL FIELD

The present disclosure relates to apparatus and methods for applying paint or other coatings to articles, particularly, automotive vehicles.

BACKGROUND

Applicators, such as paint guns or paint bells, are used to spray coatings, paint, sealants, etc., to articles, such as a vehicle and/or individual vehicle parts or subassemblies. Such applicators can be stationarily positioned in a paint booth or attached to a programmable robotic applicator. The location of the fixed applicators relative to the article and to each other, or the programmed path of the robotic applicator must be determined to ensure complete coverage of the article surfaces. Typically, the applicators are arranged in a trial location and paint or other coating applied to an actual article. The coating coverage of the article is then checked. Adjustments are made to the applicator positions or the robotic path of movement to address coverage deficiencies.

This has the economic disadvantage of wasting paint, is environmentally unfriendly since coatings which have been sprayed and are not adhered to the article surface must be collected and removed from water and air before the water and air can be recycled or exhausted from the paint booth. The application of trial coatings to an article can also render the article unusable as a finished product. Additional time and material is also consumed since it is necessary to prepare or mix the coating ingredients prior to application to the article.

SUMMARY

In one aspect, a method of locating a position of a coating applicator in a coating process for applying coating material onto an article includes positioning markable material onto an article to be coated; attaching a marker to a spray head via a positioning member to position a media depositing end of the marker at a distance corresponding to the distance of the article from the spray head; and moving the article past the marker so that the marker deposits a visible track on the markable surface simulating a center line of a coating spray pattern on the article.

The method can include forming the positioning member of at least one extensible member mounted between the applicator head and the marker to accommodate variations in topography of the article being coated relative to the applicator head as the one of the article and applicator head move relative to the other.

The method can further include forming the extensible member of at least one flexible strip removably coupled between the applicator head and the marker.

The method can further include forming the extensible member of a spiral spring removably coupled to the applicator head and the marker.

The method can further include positioning a plurality of applicator heads side by side in a generally coaxial row, attaching marker via one positioning member to each applicator head, and moving the article past the row of applicator heads so that each marker deposits a visible track on the markable surface mounted on the article to be coated.

The method can further include providing the plurality side by side applicator heads in the first row, and providing the plurality of applicator heads in a second row laterally offset from the first row.

The method can further include laterally offsetting the applicator heads in the second row from the applicator heads in the first row to define a degree of overlap between spray patterns provided by the first row applicator heads and spray patterns provided by the second row of applicator heads.

The method can further include at least one applicator head oriented vertically over the article to be coated to deposit the visible track by the marker on a generally horizontally extending surface of the article to be coated.

The method can further include providing at least one applicator head oriented in a horizontal position relative to the article.

In one aspect, an apparatus for locating a position of a coating applicator in a coating process for applying coating material by an applicator head onto a surface of an article. The apparatus includes a markable surface adapted to be removably applied to a surface of an article to be coated; a marker capable of depositing a visible track on the markable surface as the article and the marker move relative to each other; and a positioning member attachable to an applicator head and carrying the marker.

The apparatus can further include at least one extensible member mounted between the applicator head at one end and carrying the marker at an opposed end.

The extensible member further can at least one flexible strip removably coupled to the applicator head and carrying the marker.

The extensible member can further include a non-metallic spiral spring removably coupled to the applicator head and carrying the marker.

In one aspect, a collar can be removably attachable to an applicator head. A plurality of holders are carried by the collar and arranged in at least one linear row. Resilient attachment members coupled to each holder and carry a marker to enable the markers to each deposit a visible track on the markable surface attached to the surface to be coated where in the combined tracks define a spray pattern of the applicator head.

BRIEF DESCRIPTION OF THE DRAWINGS

The various features, advantages and other uses of the present paint/coating applicator locating apparatus and method will be understood by referring to the following detailed description and drawing in which.

DETAILED DESCRIPTION

Figure 1:
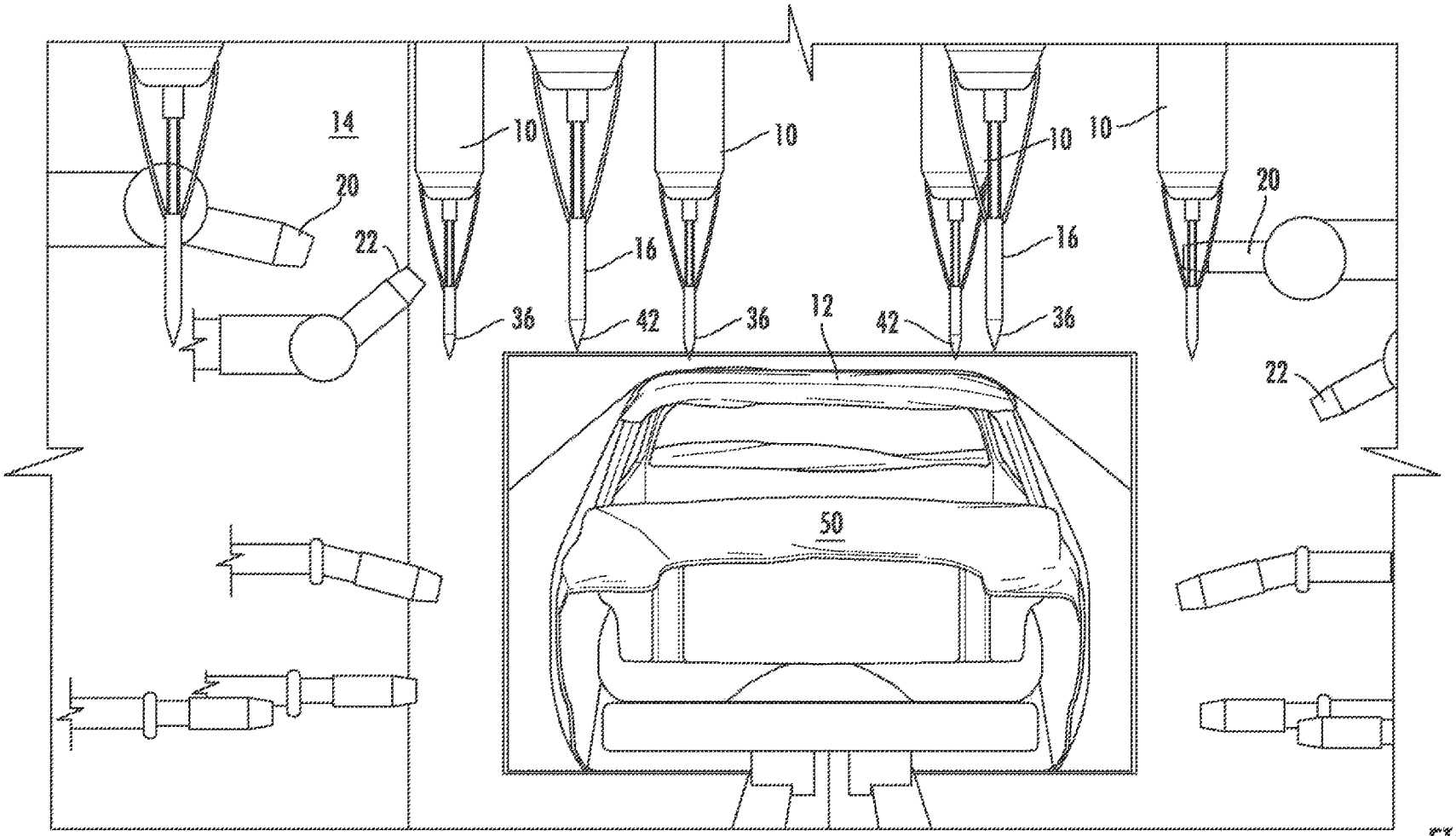
FIG. 1 is a perspective view showing one aspect of the present apparatus.
Figure 2:
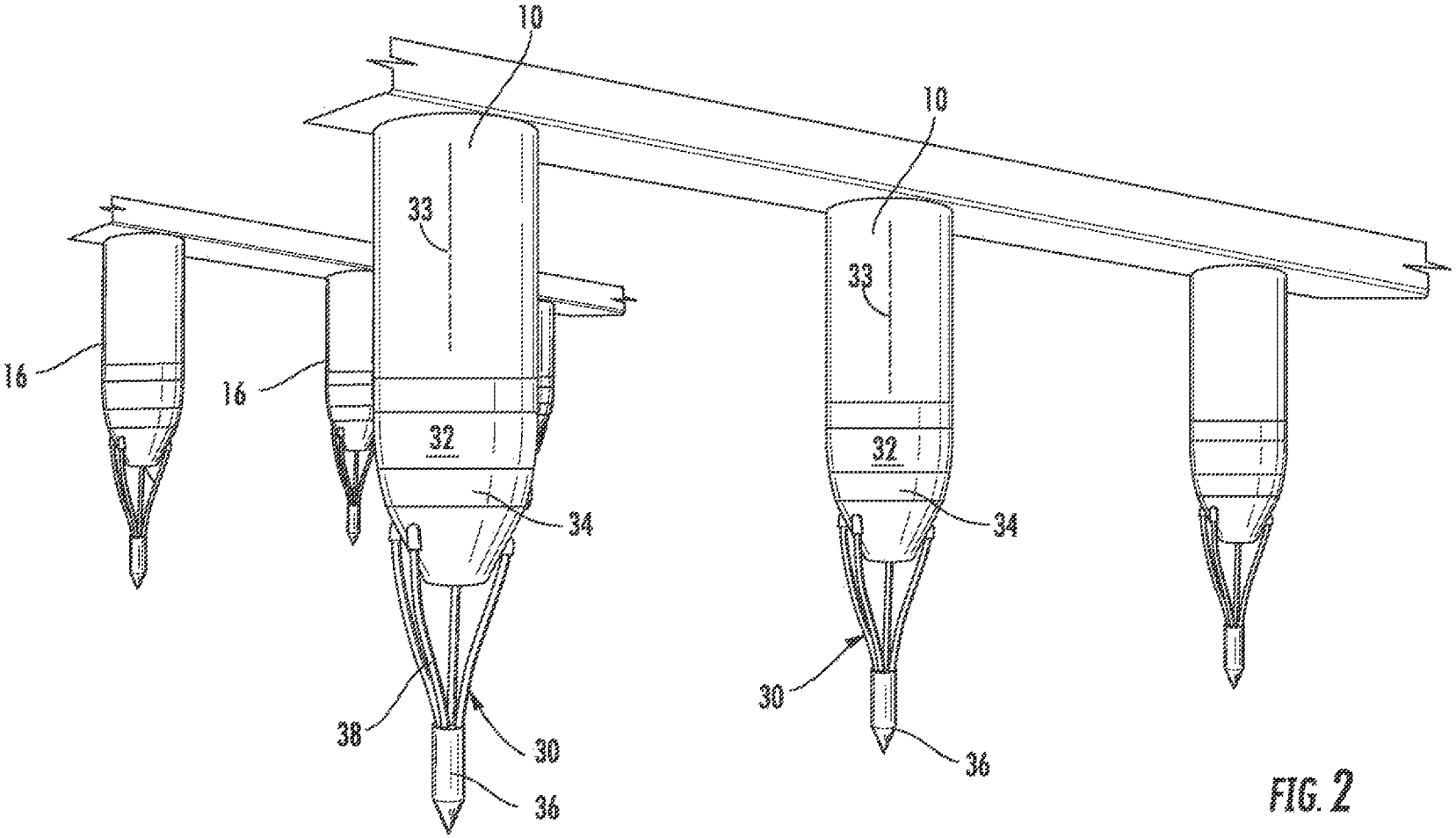
FIG. 2 is an enlarged perspective view of one aspect of the apparatus employed on stationarily mounted spray applicators.
Figure 3:
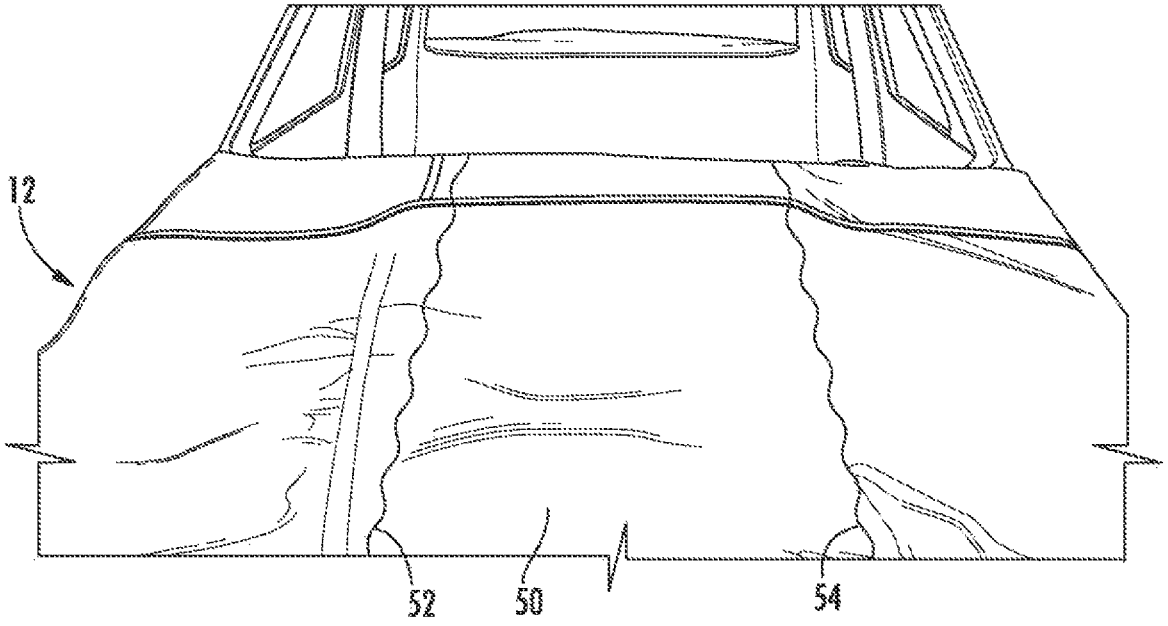
FIG. 3 is a perspective view showing a first pass of the applicators shown in FIG. 2 over a markable surface attached to the article to be coated.

Referring to FIGS. 1 and 2, there is depicted one aspect of a coating application which depicts, by example, at least one or a plurality of stationarily fixed coating applicators, such as spray guns or spray bells, in a paint booth through which an article, such as an automotive vehicle having surfaces to be coated, moves, typically along a conveyor. It will be understood that any other article to which a coating is to be applied by a stationarily positioned coating applicator or a programmed robot carrying a coating applicator on a movable arm in a predetermined path can also use the present apparatus and method.

At least one or a plurality of stationarily fixed vertically oriented applicators or spray guns, 10 four spray guns 10 shown by example in FIG. 1, are mounted in coaxially line transverse to the path of movement of the automotive vehicle 12 by a conveyor through a paint area, such as a paint booth 14. Each applicator 10 may be equally spaced from the other applicators 10 or provided at different non-equal distances apart from the other applicators 10 depending upon the surface or surfaces to be coated, or arranged in a linear row or offset from each other in a non-row arrangement, laterally across the path of movement of the vehicle through the paint booth 14. A second set of applicators 16 are also mounted in a vertical orientation in the paint booth 14 along a coaxial axis longitudinally spaced, or laterally offset from each other, within the booth 14 from the first row of applicators 10 in the paint booth 14.

Either paint bell or paint gun applicators 10 or 16 may be employed when the application using the present apparatus and method is a coating or painting application of the automotive vehicle 12. All of the applicators 10 and 16 are mounted in a vertical orientation for applying a coating or paint in a spray pattern determined of the output orifice of each applicator 10 and 16 onto an underlining surface of the vehicle 12 as the vehicle 12 moves longitudinally through the paint booth 14.

Also within the scope of the present apparatus and method are the use of horizontally or angularly mounted applicators 20, 22, etc., on one or both sides of the vehicle. The applicator end of each horizontally or angularly oriented applicator 20 and 22 may be disposed essentially horizontally with respect to the vertical side walls of the booth 14 or at a downward or upward extending angle, as shown in FIG. 1, from horizontal. The orientation of the outlet of the applicators 20 and 22 is chosen to suit the particular shape of the surface of the article 12 being coated.

Referring now to FIG. 2, there is depicted an enlarged view of two of the applicators 10. Although each applicator 10, in this example, is depicted as a spray bell, it will be understood that some or all of the applicators 10 can be constructed as spray guns.

A positioning member 30 is attached at one end to an applicator head of the applicator bell 32 by adhesive tape 34 or other attachment devices, some of which may include portions non-removably fixed to provide a removable attachment to the exterior surface of the bell 32 itself. The opposite end of the position member 30 is coupled to one or more markers 36 which are configured for applying a visible mark onto a printable or markable surface 50 attached to the article being coated, such as the exterior surface of the vehicle 12.

The positioning member 30 in one aspect, may be formed of one or a plurality of extensible members, such as thin, bendable, flexible strips 38, i.e., plastic strips 38, which can be attached at a suitable position on the exterior surface of the applicator bell 32 and configured substantially coaxially, about a longitudinal centerline 33 of the bell 32 to receive and support the marker 36 or a collar or sleeve for receiving the marker 36.

The positioning member 30 is resilient to provide a biasing force to hold the marker 36 against the surface 50 on the vehicle 12, yet enables the marker 36 to remain on the markable surface if the surface topography changes as the vehicle 12 moves through the paint booth 14. The positioning member 30 can flex or bend to reduce or increase the distance of the marker 36 relative to the spray bell 32, as required to maintain the marker 36 in contact with the markable surface 50 on the vehicle 12 as the topography of the vehicle changes during movement of the vehicle 12 through the booth 14.

The marker 36 can be any suitable marker capable of depositing a visible mark on the markable surface 50 attached to the article 12 to be coated. For example, the marker 36 can be an ink pen, felt tip pen, a pencil, or a device capable of applying a visible mark on the markable surface 50 when contacted by the marker 36. The marker 36 may also be a water spray applicator capable of spraying a stream or mist of colored media onto the markable surface.

The visible medium dispensed by the marker 36 can be any color, such as a color which is easily visible and contrastable with respect to the color of the markable surface 50. In some applications, the markers 36 of each of the applicators 10 may be provide in the same or different colors. Further, the markers 36 may be provided in one color for a first pass of the article 12 past the applicators 10 and then replaced by markers 36 capable of disposing a second different color easily contrastable and visible from the first color on to the markable surface 50 during a second pass of the article or vehicle 12 past the applicators 10.

In the example shown in FIGS. 1 and 2, the second set of applicators 16 are laterally offset from the first applicators 10 to provide, in the case of a spray pattern of an applicator 10 or 16 which overlaps to a certain extent, such as 50% to 75% of the spray pattern of the first applicator 10. This provides a second layer of the coating onto the article 12. In this event, the color of the markers 36 on the first row of applicators 10 can be of the same color, or of a different color employed in the markers 42 on the second set of applicators 16.

The same lateral and offset arrangement of the sets of applicators 10 and 16 can also be applied to the side wall mounted horizontal or angular applicators 20 and 22 on one or both sides of the vehicle 12.

The markable or printable surface 50 can be any surface capable of receiving the visible medium supplied by the markers 36 and 42. For example, the printable surfaces 50 can be paper, fabric, without fibers, markable plastic, etc. The printable surfaces 50 can be applied as a single sheet or in multiple overlapped or joined sections, shown in FIGS. 1 and 2, to cover all or the portion of the exterior surface of the article 12 to be coated. As shown in FIGS. 1 and 2, portions of the printable material 50 are fixed, such as by tape for removability, to the vehicle hood, vehicle roof and sides of the vehicle 12, such as the front fender, doors, rear fender and trunk, for example.

In application, the applicators 10 and 16, and/or the applicators 20 and 22, are mounted in an initial position with the ends of the markers 36 and 42 disposed in a position to contact the appropriate portion of the markable surface 50 on the vehicle 12 as the vehicle 12 traverses the rows of applicators 10, 16, 20 and 22.

As in the front edge of the vehicle hood approaches the applicator 10 the markers 36 will contact in the case of a pen or pencil, the markable member 50, and, deposit the visible marking media in separate continuous or discontinuous traces or tracks 52 and 54 for the two applicators 10 shown in FIG. 2. The tracks 52 and 54 define the center point of the spray pattern of each applicator 10.

Figure 4:
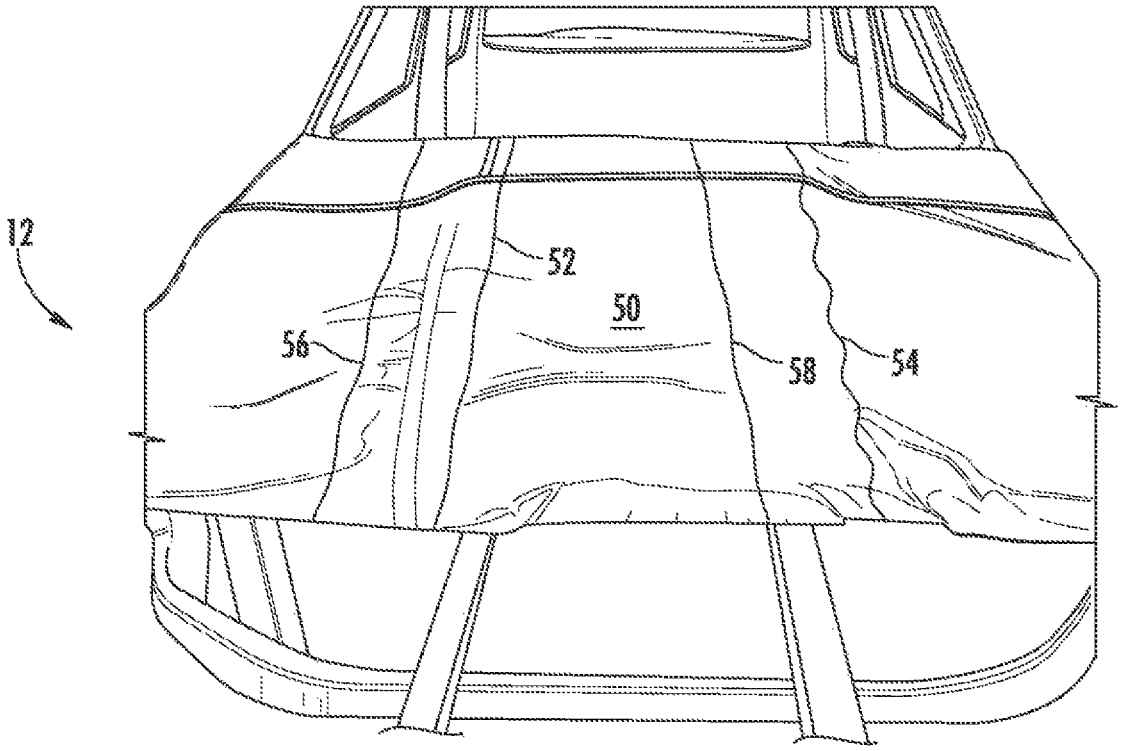
FIG. 4 is a perspective view showing a second pass of the applicators over the markable surface on the article to be coated.

As the vehicle continues its movement through the booth 14, the second row of applicators 16 markers 42 pass in contact with the printable material 50 on the vehicle hood leaving second tracks 56 and 58. As shown in FIG. 4, the second tracks 56 and 58 are laterally offset from the first tracks 52 and 54 by the desired overlap percentage of 50% to 75%, for example. Multiple passes of the applicators 10 and 16 past the vehicle 12 can also be performed to simulate additional application of coating layers to the vehicle 12. Each additional pass will result in separate tracks on the surface 50 which can be of different colors.

This unique method and apparatus of defining a location of spray applicators with respect to an article to be coated is environmentally friendly since no paint or coating material is applied to the vehicle 12. The apparatus and method maintain the vehicle 12 in a pristine state for eventual use as a finished vehicle for sale. The visible tracks 52, 54, 56 and 58 provide an easily recognizable trace of the center line of each applicator 10 and 16 over a surface of the vehicle 12 thereby enabling the position of any applicator 10 and 16 to be adjusted if necessary to provide the desired position and overlap of the spray coating of the article 12.

FIGS. 5, 6 and 7A and 7B depict an alternate aspect or example of the positioning member 30 which is attachable to an applicator gun or bell for locating the path movement of the applicators 10, 16 with respect to an article moving across the fixed location of the applicators 10 or 16. In this aspect 78, a hollow collar 60, with set screws or other attachment means 62 mounted thereon, is provided for releasable attachment to the exterior surface of the spray bell or spray gun forming the applicators 10 or 16. One end of a biasing member, such as a helically or spiral coil spring 64 formed of a non-metallic material, for example, plastic, composites, etc., is a fixed to one end of the collar 60. The opposite end of the biasing member 64 is removably connected to marker 66, depicted in this example as a felt tip pen. The felt tip pen can be adhesively or otherwise removably attached to the end 65 of the biasing member 64. Alternately, the end 65 of the biasing member 64 can be fixed to a hollow collar 68 also containing one or more set screws 70 or by a press or friction bit for releasably and fixably mounting the marker 66 therein.

The biasing member 64 functions in the same manner as the flexible strips of the previous position member example to provide a resilient force biasing the end of the marker 36 into contact with the markable surface 50 as well as allowing the marker 66 to move axially up and down with respect to the center axis of the applicator gun or applicator bell 10 or 16 to which the collar 60 is attached to accommodate surface variations in the topography of the article being coated.

Figure 6:
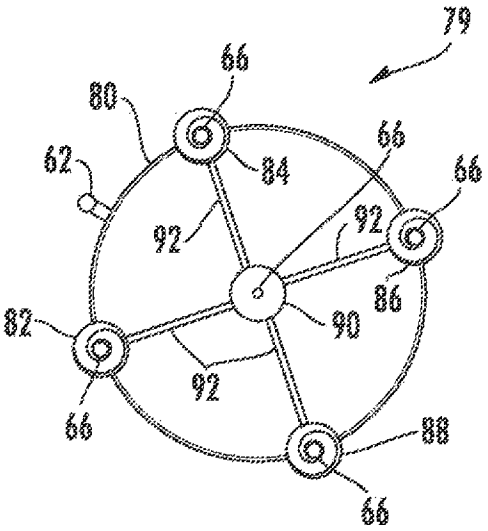
FIG. 6 is an end view of another aspect of the apparatus.
Figure 5:
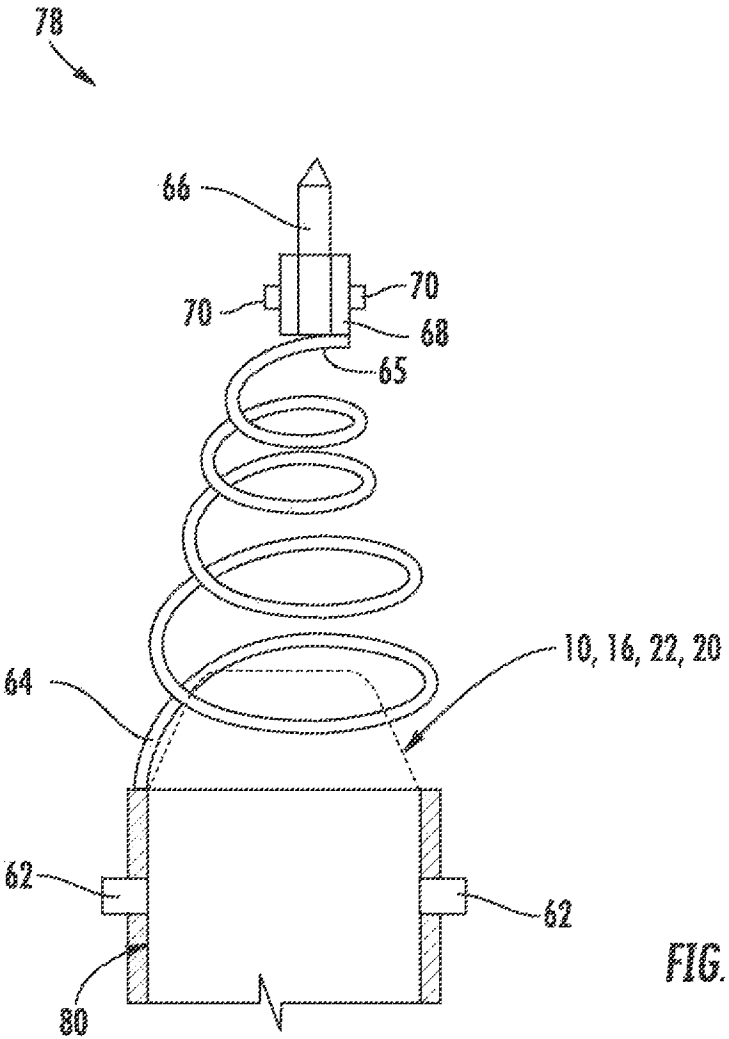
FIG. 5 is a perspective view showing another aspect of the present apparatus.
Figure 7B:
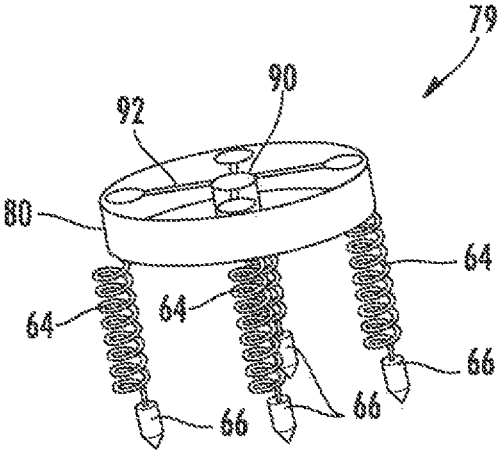
FIG. 7B is an alternate partial perspective view of the example shown in FIG. 7A.
Figure 7A:
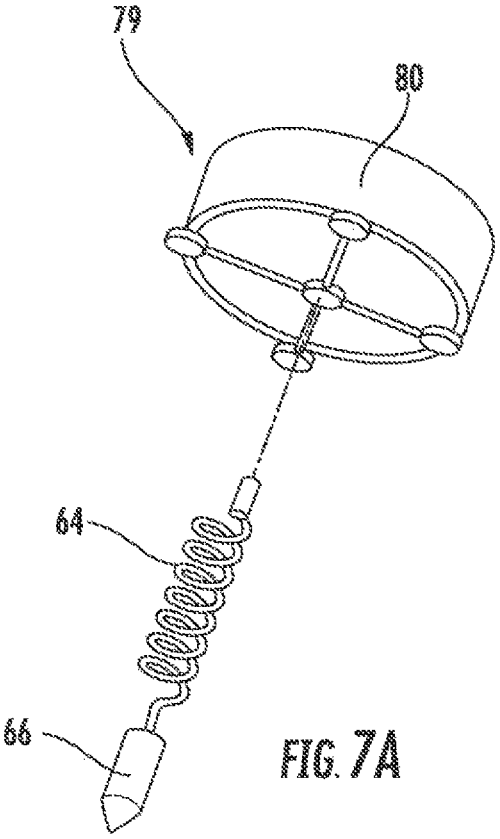
FIG. 7A is an exploded, partial perspective view of one example of the apparatus.

FIGS. 6 and 7A and 7B depict yet another alternate example or aspect 79 of the positioning member 78 which also includes a hollow collar 80 mountable via set screws, not shown, onto one end of the applicator gun or bell 10 or 16. The collar 80 supports a plurality, such as four or five hollow sleeves, with five sleeves 82, 84, 86, 88 and 90 depicted by example in FIGS. 6 and 7A and 7B. The sleeves 82, 84, 86 and 88 are fixably mounted on one end of the collar 80. Another hollow sleeve 90 is centrally located between the sleeves 82, 84, 86 and 88 and fixed by interconnecting support rods 92 coupled between the centrally located sleeve 90 and one or more of the sleeves 82, 84, 86 and 88.

Figure 8:
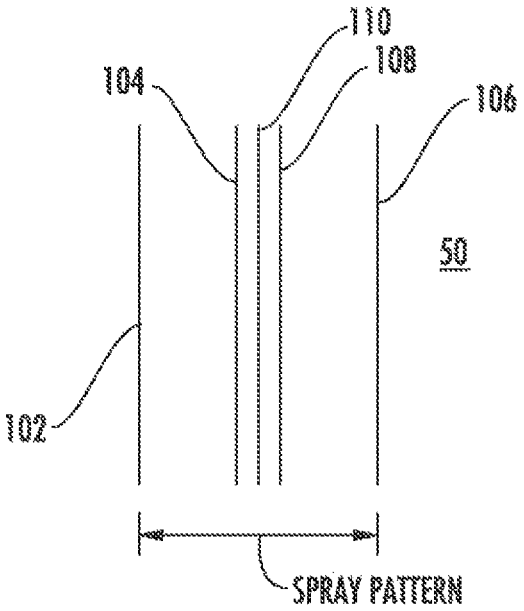
FIG. 8 is a plan view of the tracks made on the markable surface by the apparatus shown in FIGS. 6 and 7.

Each hollow sleeve 82, 84, 86, 88 and 90 fixably supports one of the biasing members 64 carrying one marker 66 at one end. As shown in FIG. 8 when the vehicle 12 moves past the positioning member 78, the markers 66 leave tracks 102, 104, 106, 108 and 110 on the markable surface 50. The tracks 102 and 106 define the outer limits or edges of the spray pattern of a single spray gun 10 or 16. The centrally located tracks 104, 108 and 110 define the center line of the applicator spray pattern.

Alternately, a single row of three sleeves 82, 86 and 90, and associated markers 66, can also be employed to generate the track pattern 102, 106 and 110 shown in FIG. 8. In the various examples of devices and methods described herein, including but not limited to the exemplary positioning members 30, 78 and 79, preferably no metallic parts or components are used.

Figure 9:
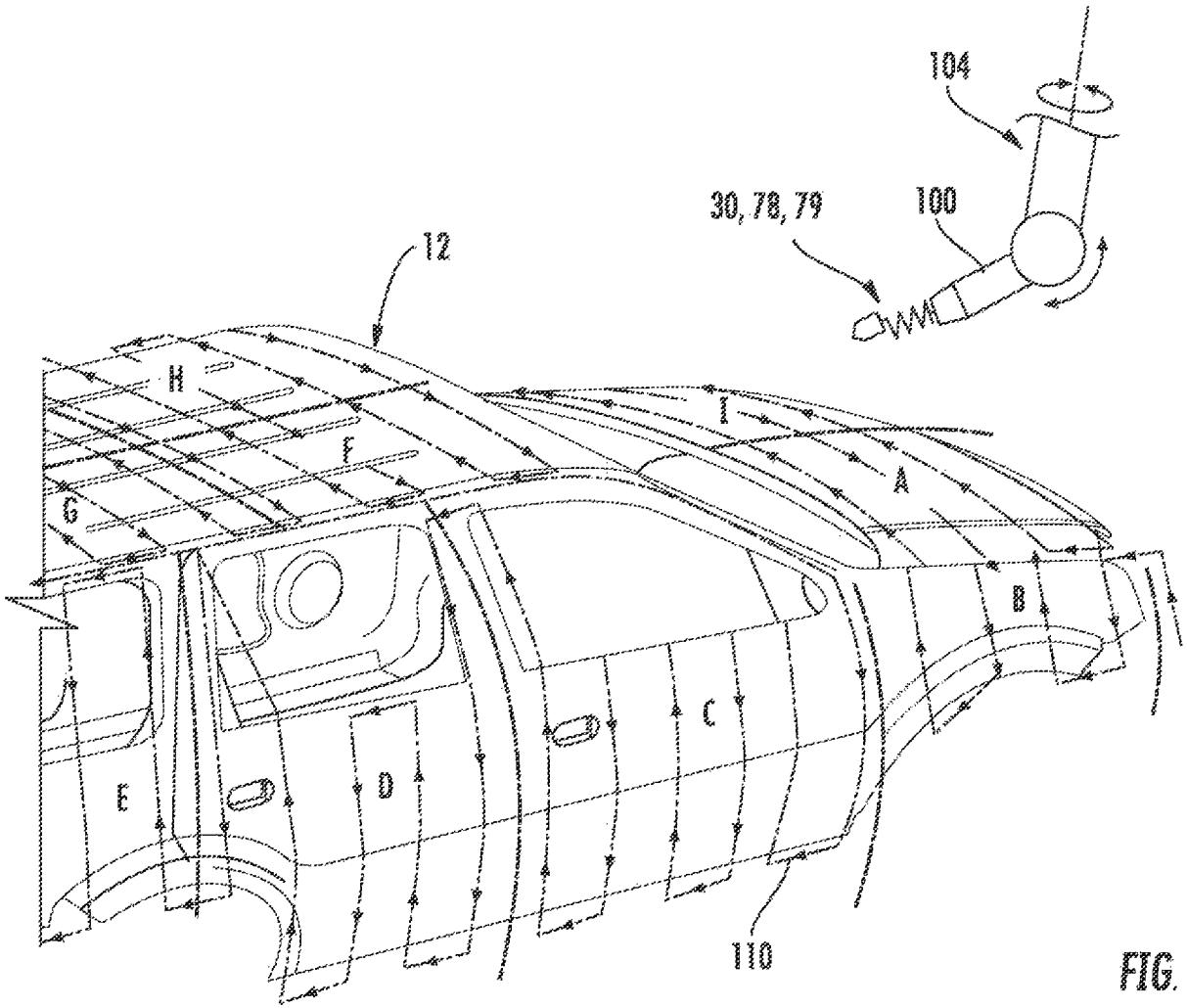
FIG. 9 is a perspective view of another aspect of the present apparatus.

The applicators 10, 16 and 78 may also be applied to an applicator arm 100 of programmable robotic painting or coating applicator 104 as shown in FIG. 9. FIG. 9 also depicts an example of individual programmed paths of movement 110 of one or a plurality of robots 104 (not shown) in sections or areas A-I applying separate coatings of paint or other coating material on to the surface of the vehicle 12 as the vehicle 12 remains stationary in the paint booth 14 or is moving longitudinally through the paint booth 14. For example, a single robot 104 can apply paint or other coatings in the path of movement 110 depicted by areas C and Din FIG. 9. Separate or single robots 104 can apply paint to areas A and I at the front end of the vehicle or on one side of the front end of the vehicle and in a fender portion on the opposite side of the vehicle (not shown).

The attachment of any one of the markers and biasing members described above to the applicator end of each robot 104 allows the markers to trace one or more tracks on the markable surface 50 applied to each surface of the vehicle 12 thereby defining the path and movement of each robot. This program path may be adjusted to provide the desired center line of paint spray, or the degree of overlap of a second path of the robot or other robots over the same portion of the vehicle 12. This simplifies the adjustments made to the program path of each robot to ensure the desired paint coverage of the vehicle 12.

The method of using the apparatus described above includes attaching the markers and the positioning members to one or more of the applicator guns or bells in a stationary applicator arrangement or on the end of a moveable robot arm. The positioning members are adjusted so that the media deposit end of the markers is positioned to intercept and contact the markable surface 50 mounted on the vehicle as the vehicle 12 longitudinally moves through the booth 14. The vehicle 12 or article to be coated is then moved into a start position in the booth 14 and subsequently advanced through the booth 14. Each marker deposits a visible track of media on the markable surface 50 on the vehicle 12 during such vehicle advance.

A second pass or the use of a second row of applicators each carrying a marker and a positioning member deposits a second track onto the surface 50 at a preset degree of overlap of multiple coating sprays onto the surface. The method also allows adjustment of the position of any of the applicators as necessary to provide the desired coating coverage on the article.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of locating a position of a coating applicator in a coating process for applying coating material onto an article comprising:

positioning markable surface onto an article to be coated;

attaching a marker to a spray head via a positioning member to position a media depositing end of the marker at a distance corresponding to the distance of the article from the spray head; and moving the article past the marker so that the marker deposits a visible track on the markable surface simulating a center line of a coating spray pattern on the article, wherein the positioning member comprises at least one extensible member mounted between the spray applicator head at one end and carrying the marker at an opposed end, wherein the extensible member comprises at least one of a flexible strip or a spiral spring removably coupled to the spray applicator head and carrying the marker.

2. The method of claim 1 further comprising:

positioning a plurality of applicator heads side by side in a generally coaxial row;

attaching one marker by, one at least positioning member to each applicator head;

moving the article past the row of applicator heads so that each marks deposits a visible track on a markable surface mounted on the article.

3. The method of claim 2 further comprising: providing the plurality of side by side applicator heads in the first row; and providing the plurality of applicator heads in a second row laterally offset from the first row.

4. The method of claim 3 further comprising: laterally horizontally offsetting the applicator heads in the second row from the applicator heads in the first row to define a degree of overlap between spray patterns provided by the first row applicator heads and spray patterns provided by the second row of applicator heads.

5. The method of claim 1 further comprising: at least one applicator head oriented vertically over the article to be coated to deposit the visible track by the marker on a generally horizontally extending surface of the article to be coated.

6. The method of claim 1 further comprising: providing at least one applicator head oriented in a horizontal position relative to the article.

7. A method of locating a position of a coating applicator in a coating process for applying coating material onto an article comprising:

positioning markable surface onto an article to be coated;

attaching a marker to a spray head via a positioning member to position a media depositing end of the marker at a distance corresponding to the distance of the article from the spray head;

moving the article past the marker so that the marker deposits a visible track on the markable surface simulating a center line of a coating spray pattern on the article; and forming the positioning member of at least one extensible member mounted between the spray head and the marker to accommodate variations in topography of the article being coated relative to the spray head as the one of the article and spray head move relative to the other, wherein the extensible member comprises at least one of a flexible strip or a spiral spring removably coupled to the spray applicator head and carrying the marker.

* * * * *